United States Patent [19]

Weidenhaupt et al.

[11] Patent Number: 4,679,387

[45] Date of Patent: Jul. 14, 1987

[54] REINFORCING CORD WITH WRAPPING WIRE

[75] Inventors: Wolfgang Weidenhaupt, Erkelenz; Peter Dismon, Heinsberg-Proselen, both of Fed. Rep. of Germany

[73] Assignee: AKZO NV, Arnhem, Netherlands

[21] Appl. No.: 807,767

[22] Filed: Dec. 9, 1985

Related U.S. Application Data

[63] Continuation of Ser. No. 610,877, May 16, 1984, abandoned.

[30] Foreign Application Priority Data

May 16, 1983 [DE] Fed. Rep. of Germany ..... 3317744

[51] Int. Cl.[4] ..... D02G 3/48; B60C 9/00; D07B 1/06

[52] U.S. Cl. ..... 57/212; 57/215; 57/218; 57/219; 57/902; 152/451; 152/527; 152/556

[58] Field of Search ..... 57/215, 219, 210–214, 57/902, 218; 152/527, 556–563, 451

[56] References Cited

U.S. PATENT DOCUMENTS

| | | | |
|---|---|---|---|
| 3,798,350 | 3/1974 | Clarke | 57/215 X |
| 3,813,772 | 6/1974 | Adams | 57/215 X |
| 3,831,370 | 8/1974 | Gilmore | 57/215 |
| 3,922,841 | 12/1975 | Katsumata et al. | 57/215 |
| 4,349,063 | 9/1982 | Kikuchi et al. | 57/215 X |

FOREIGN PATENT DOCUMENTS

| | | |
|---|---|---|
| 369285 | 5/1930 | Belgium . |
| 373928 | 11/1930 | Belgium . |
| 803801 | 4/1951 | Fed. Rep. of Germany . |
| 2112332 | 10/1971 | Fed. Rep. of Germany . |
| 2427934 | 1/1975 | Fed. Rep. of Germany . |
| 731314 | 9/1932 | France . |

*Primary Examiner*—John Petrakes
*Attorney, Agent, or Firm*—Michael J. Striker

[57] ABSTRACT

A reinforcing cord made of several steel wires includes a metal wrapping wire coiled around steel wires. The hardness of the wrapping wire is substantially less than the hardness of the steel wires. Preferably the wrapping wire is a flat wire whose longer side engages the cord.

5 Claims, 6 Drawing Figures

REINFORCING CORD WITH WRAPPING WIRE

This is a continuation of application Ser. No. 610,877, filed May 16, 1984, now abandoned.

BACKGROUND OF THE INVENTION

The present invention relates in general to reinforcing cords made of several metal wires for reinforcing elastomeric products such as wires and in particular in relates to such a cord which is provided with at least one wrapping wire coiled thereon.

Such a reinforcing cord is known from the German Pat. No. 803,801. The wrapping wire in this known cord has the function to hold the constituent strands together and prevent dejoining of steel wires in the strands. The wrapping wire itself, however, does not contribute to the overall tensioning strength of the reinforcing cord. When a cord of this kind is embedded in an elastomeric material, for example, in a pneumatic tire of a vehicle, then in loading this material the risk of brinnelling or fretting corrosion will result. The fretting corrosion is one of the causes which lead to the shortening of service life of elastomeric products reinforced by the cords.

The risk of fretting corrosion is always present when two metal surfaces are in contact and subject to minute mutual shifting when under load. During the dynamic loading of reinforced elastomeric products such a condition occurs between the metallic wires of the cord which takes up the load of the product and the helical wrapping wire wound in contact with the steel wires.

SUMMARY OF THE INVENTION

It is therefore a general object of the present invention to overcome the aforementioned disadvantages.

In particular, it is an object of the invention to provide an improved reinforcing cord of the aforedescribed kind in which the risk of fretting corrosion of supporting steel wires is substantially reduced.

Another object of this invention is to provide such an improved reinforcing cord which substantially increases the service life of elastomeric products in which it is employed and at the same time maintains all advantages of prior art reinforcing cords.

In keeping with these objects and others which will become apparent hereafter, one feature of the invention resides, in a reinforcing cord assembled of several strands of steel wires for use in elastomeric products such as pneumatic cord tires, for example, in the provision of a wrapping wire of metal wound helically around the strands whereby the hardness of the wrapping wire is substantially less than the hardness of the steel wires in the strands.

It has been found that the service life of pneumatic tires for motor vehicles is substantially increased when the hardness of each wrapping wire is about 30 to 60%, preferably about 30 to 50% less than the hardness of the steel wires. The hardness of steel wires used in reinforcing cords for pneumatic tires is between 795 to 917 HV 0.05 whereby the hardness HV is given on Vickers scale and is determined according to the German Industry Standard DIN 50133. This steel wire has a tensional strength between 2,600 to 3,000 N/mm$^2$. Recently, steel wires have been made available which have a higher tensile strength, for example 3,400 N/mm$^2$ and these wires have a correspondingly increased hardness.

For example, if steel wires of a hardness of about 917 HV 0.05 and of a tensile strength of about 3,000 N/mm$^2$ are employed for the manufacturing of a reinforced cord tire, then according to this invention the wrapped around tie wire has a hardness between 275 to 509 HV 0.05, preferably 459 HV 0.05. This tie or wrapping wire has a tensile strength between 900 and 1,800 N/mm$^2$, preferably up to 1,500 N/mm$^2$.

If the wrapping wire according to this invention is also a steel wire then its hardness and tensile strength is determined in conventional manner by selecting a suitable kind of steel material (the amount of carbon component, the amount of alloying constituents) by reducing the pre-treatment or by a suitable heat after-treatment. For the wrapping wire, however, it is also possible to use different metal than steel provided that its hardness ratio or tensile strength relative to the cord wires is preserved.

In the before mentioned German Pat. No. 803,801 an application of a flat wrapping wire in the reinforcing cord has been described. The flat wrapping wire increases the resistance against the disjoining of the cord strands and at the same time the reduction of the overall diameter of the cord is achieved.

According to another feature of this invention, it has been found that when certain geometric relationships are established in the cross-section of the flat wrapping wire the risk of fretting corrosion in the reinforcing cord is further reduced. In contrast to wrapping wires having circular cross-section, the application of a wrapping wire of a flat cross-section has the advantage that a contact line is created with the underlying steel wires and not a contact point. When subjected to dynamic stress, then according to loading conditions in a cord tire, the outer forces acting on the reinforcing cord are distributed over a larger area and consequently the specific load per unit area is smaller both for the supporting steel wires as well as for the wrapping wire. It is of advantage when the wrapped around flat wire has a higher expansion value for a length of lay than the corresponding round wire. The increased module of elasticity or extension results in an improved ductile behavior and hence in an increased loadability of the tire.

The service life of an elastomeric product containing the reinforcing cords of this invention is further increased when the flat wrapping wire has a broad side which contacts the strands of the reinforcing steel wire. The flat wrapping wire is either coiled about a stationary reinforcing cord or alternately the reinforcing cord is rotated about its longitudinal axis and the wrapping is laid thereon.

The flat wrapping wire can be prepared from a wire of round cross-section either by rolling or by drawing the round wire through a drawing die of a rectangular cross-section whereby any shaping of the wire in a direction transverse to its feeding direction is avoided.

It has been found that the risk of fretting corrosion is minimized when the ratio of the thickness to the breadth of the wrapping wire is between 0.4 and 0.7 preferably between 0.5 and 0.6.

The method of this invention leading to the reduction of fretting corrosion is in practice applicable to all reinforcing cords using wrapping wires.

Among the numerous possible construction of reinforcing cords according to this invention, the following constructions are specified by way of an example:

| |
|---|
| $4 \times d + U$ |
| $7 \times 3 \times d + U$ |
| $7 \times 4 \times d + U$ |
| $3 + 9 \times d + U$ |
| $3 + 9 \times 15 \times d + U$ |
| $27 \times d + U$ |
| $7 \times 7 \times d + U$ |

wherein d is the diameter of reinforcing steel wires which in conventional reinforcing cords is between 0.15 and 0.25 mm; and U denotes the size of the wrapping wire or wires which in the embodiment using round cross-section has a diameter of 0.12 to 0.15 mm.

When using flat wrapping wires the ratio between the thickness to the breadth of the wire cross-section is between 0.4 and 0.7 preferably 0.5 and 0.6 mm and the cross-sectional area of the thread wire is substantially equal to the cross-sectional area of a round wire of which the flattened wire was produced, preferably between 0.01 to 0.02 $mm^2$.

The length of lay or twist of the wrapping wire is preferably between 2.5 and 5 mm. Reinforcing cords provided with wrapping wires according to this invention are preferably embedded in the carcass of the pneumatic tires.

As a rule, metal wires for the reinforcing cords according to this invention are made of carbon alloyed steel. The steel wires must insure a strong bind with the elastomeric material. For this purpose, the steel wires in the cord are coated with a layer of another material such as a plastic coating which adheres both to the steel wires and to the elastometic material. In the preferred embodiment, the steel wires in the cord are also coated with brass.

In all above described embodiments of this invention it has been found that the desired quality of reinforcing cords, namely the tensile strength, penetration of the elastomeric material or the compression module is substantially unchanged.

The compression module is determined in the following manner: a reinforcing cord or reinforcing string is embedded in an elastomeric material having a predetermined quality. The elastomeric material during the embedding is formed in a cylindrical probe of a circular cross-section and the reinforcing cord or string is embedded coaxially with the center axis of the cylinder. The best sample has a predetermined length and diameter. By loading the two circular bases of the sample a maximum permissible load is determined. Usually the maximum permissible load is reached when the lateral sides of the probe begin to buckle.

The reinforcing cords according to this invention are preferably used in the manufacture of pneumatic tires for motor vehicles, particularly for heavy-duty trucks or road construction machines.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
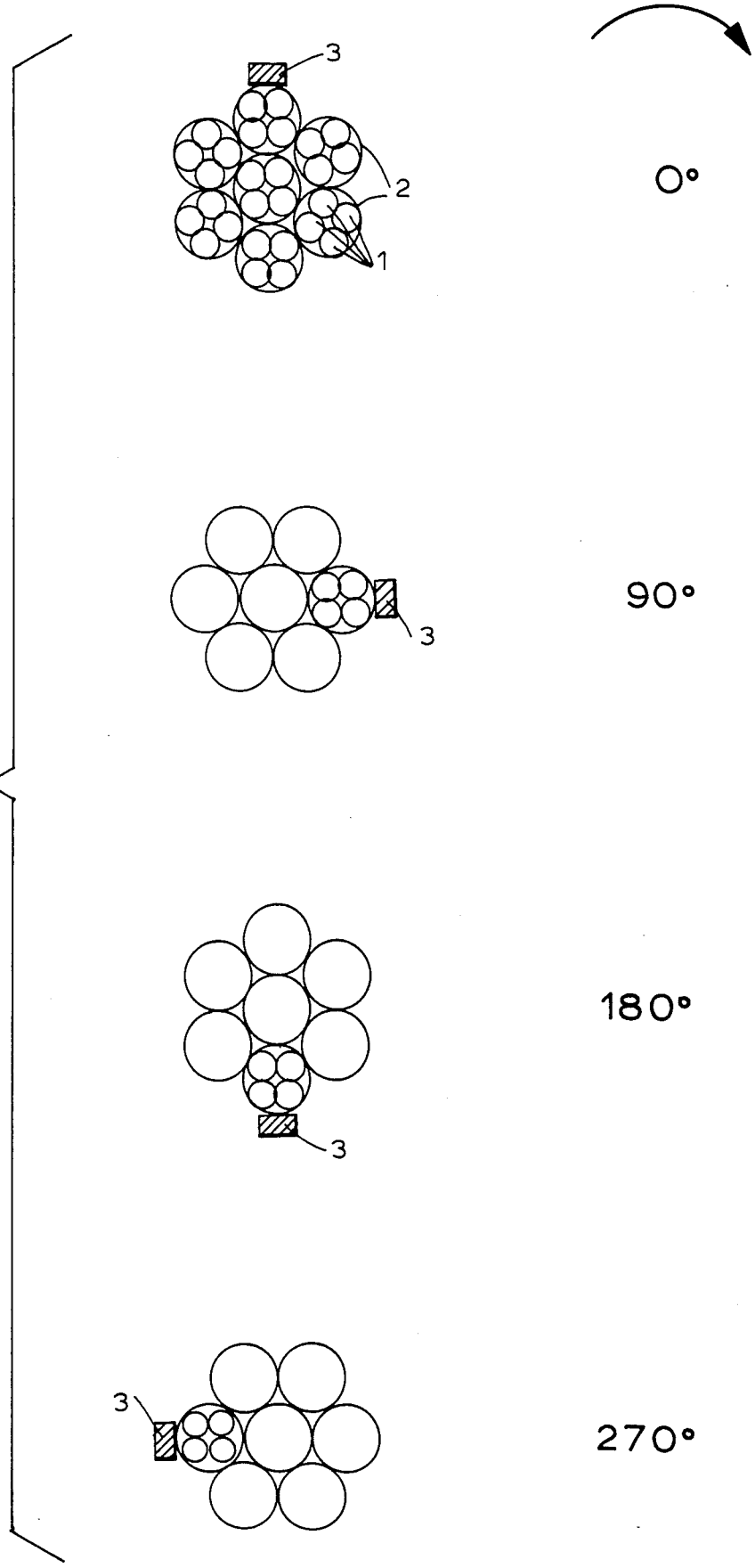
FIG. 1 shows in four sectional end views the construction of the reinforcing cord of this invention.

FIG. 1 shows an example of a reinforcing cord of this invention consisting of seven strands 2 each including four steel wires 1. The strands are twisted in the direction of arrow and are illustrated in four different cross-sections along the longitudinal axis of the cord corresponding to 0°, 90°, 180° and 270° of the twist. The strands of the cord are in contact with a broad side of a flat wrapping wire 3 which is helically wound around in the direction of the arrow. The wrapping wire 3 has lesser hardness than the strands.

Figure 2:
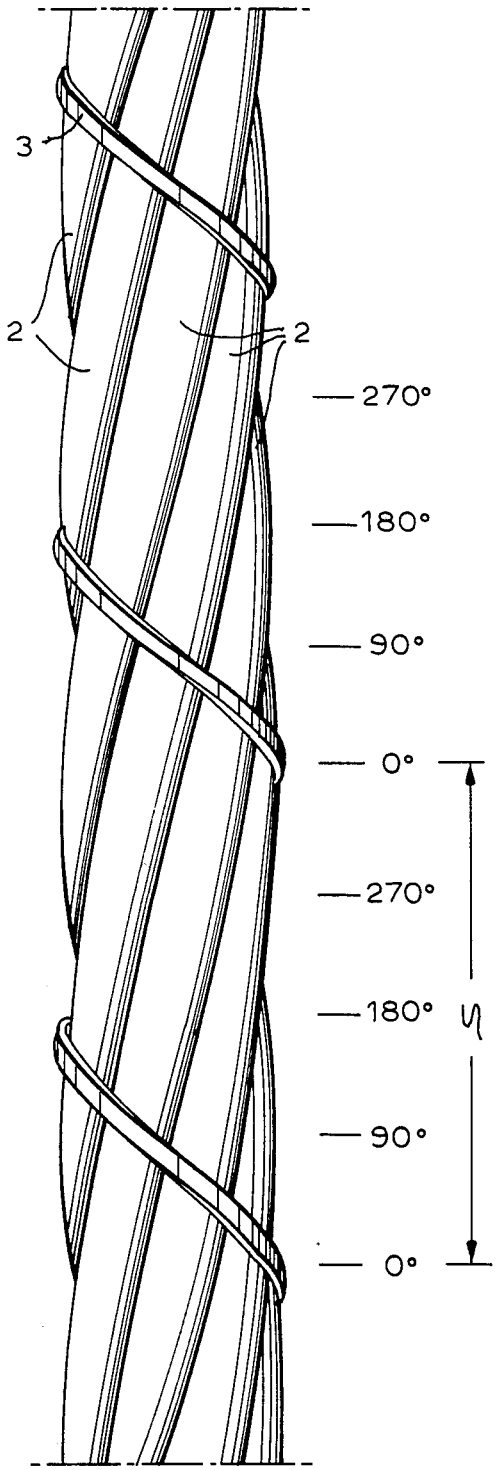
FIG. 2 shows a side view of a reinforcing cord according to FIG. 1.

The length of lay S of the wrapping wire 3 is illustrated in FIG. 2 indicating also the characteristic angular positions of the twist in accordance with FIG. 1.

It will be seen that the wrapping wire 3 forms the outermost layer of the reinforcing cord.

Figure 3:
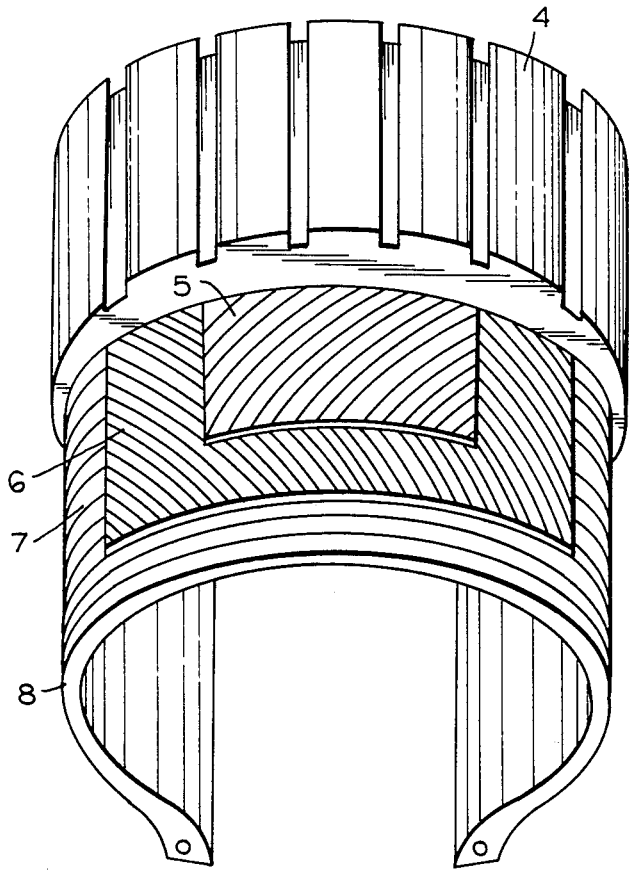
FIG. 3 is a perspective view of a cut-away portion of a pneumatic tire including the cord of this invention.

FIG. 3 shows schematically an example of a radial cord tire including the reinforcing cords of this invention. Reference numeral 4 indicates the tread of the tire in which two plies or layers 5 and 6 of reinforcing cordage are embedded. The reinforcing cords in layers 5 and 6 are oriented respectively at different angles to the circumferential direction of the tread. The reinforcing cords 7 according to this invention are embedded in the carcass 8 of the tire and are oriented in radial direction of the tire. If desired, the reinforcing cords in plies 5 and 6 can be also provided with a wrapping wire of lesser hardness in accordance with this invention.

It will be understood that each of the elements described above, or two or more together, may also find a useful application in other types of constructions differing from the types described above.

While the invention has been illustrated and described as embodied in a reinforcing cord for use in cord tires, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A reinforcing cord made of at least one strand of steel wires for reinforcing the elastomeric carcass of a cord tire, comprising at least one flat wrapping wire of metal wound helically on the strand and forming the outermost layer of the reinforcing cord, the hardness of the flat wrapping wire being between 30% to 60% of the hardness of the steel wires, the flat wrapping wire having a rectangular cross-section whereby the longer side of the cross-section of the flat wrapping wire is in contact with the steel wires, and the ratio of the shorter side to the longer side of the cross-section of the flat wrapping wire is between 0.4 and 0.7.

2. A reinforcing cord as defined in claim 1, wherein the hardness of the flat wrapping wire is between 30% to 50% of the hardness of the steelwires.

3. A reinforcing cord as defined in claim 2, wherein the ratio of the shorter side to the longer side of the cross-section of the flat wrapping wire is between 0.5 and 0.6.

4. A reinforcing cord as defined in claim 1, wherein the cross-sectional area of the flat wrapping wire is between 0.01 to 0.02 $mm^2$.

5. A cord tire having a carcass reinforced by the reinforcing cords of claim 1.

* * * * *